US006402208B1

(12) United States Patent
Shimizu

(10) Patent No.: US 6,402,208 B1
(45) Date of Patent: Jun. 11, 2002

(54) LATCH FOR OVEN

(75) Inventor: Mikio Shimizu, Ohmiya (JP)

(73) Assignee: World Kogyo Co., Ltd. (JP)

( * ) Notice: Subject to any disclaimer, the term of this patent is extended or adjusted under 35 U.S.C. 154(b) by 0 days.

(21) Appl. No.: 09/456,147

(22) Filed: Dec. 7, 1999

(51) Int. Cl.[7] ..... E05C 19/10; E05C 19/14

(52) U.S. Cl. ..... 292/123; 292/DIG. 69; 292/DIG. 66; 292/DIG. 49; 292/126; 292/240

(58) Field of Search ..... 292/DIG. 69, DIG. 66, 292/DIG. 49, 126, 122, 123, 66, 240; 126/42, 197, 192

(56) References Cited

U.S. PATENT DOCUMENTS

| | | | | | |
|---|---|---|---|---|---|
| 3,438,666 | A | | 4/1969 | Erickson | |
| RE27,291 | E | * | 2/1972 | Fowler | 292/113 |
| 4,133,337 | A | | 1/1979 | Shea | |
| 4,174,860 | A | | 11/1979 | Shea | |
| 4,364,589 | A | * | 12/1982 | Watson | 292/113 |
| 4,593,945 | A | * | 6/1986 | Arute et al. | 292/201 |
| 4,838,586 | A | | 6/1989 | Henne | |
| 4,861,078 | A | | 8/1989 | Munoz | |
| 4,917,414 | A | * | 4/1990 | Boulanger | 292/98 |
| 5,517,006 | A | * | 5/1996 | Fredriksson et al. | 219/723 |
| 6,079,756 | A | * | 6/2000 | Phillips | 292/198 |

* cited by examiner

*Primary Examiner*—Anthony Knight
*Assistant Examiner*—Matthew E. Rodgers
(74) *Attorney, Agent, or Firm*—Wallenstein & Wagner, Ltd.

(57) ABSTRACT

A latch for an oven comprises a support plate mounted within the oven. A bracket member is pivotably supported on the support plate. A handle is fixed to the bracket member and is manually operable to move the latch between the latching and unlatching positions. A latch arm is movably supported on the support plate and connected to the bracket member to be moved between the latching and unlatching positions in accordance with the movement of the bracket member. A spring is connected between the support plate and the bracket member for biasing the bracket member toward the latching or unlatching position, selectively. First and second arcuate guide projections are integrally formed with the support plate beneath the bracket member for guiding the bracket member.

11 Claims, 8 Drawing Sheets

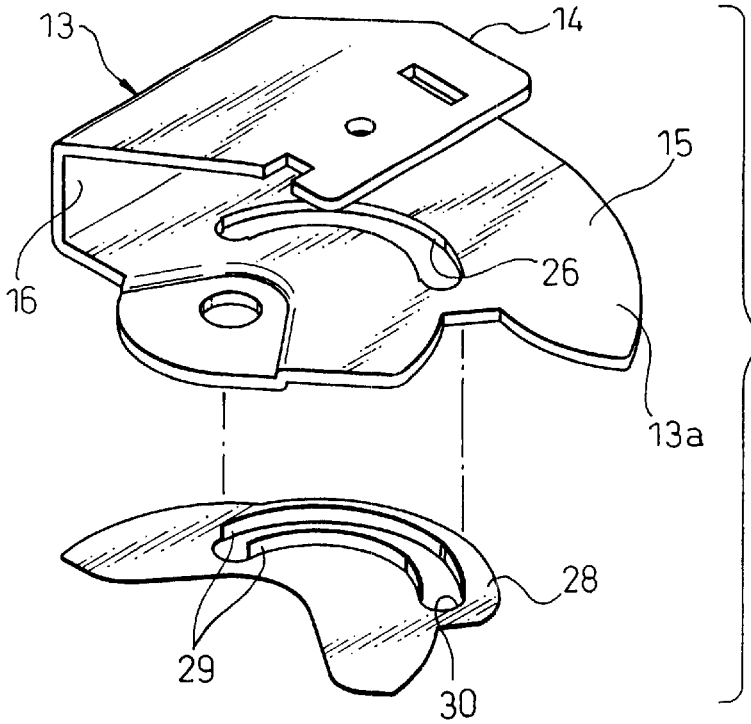
Fig.5
Fig.6
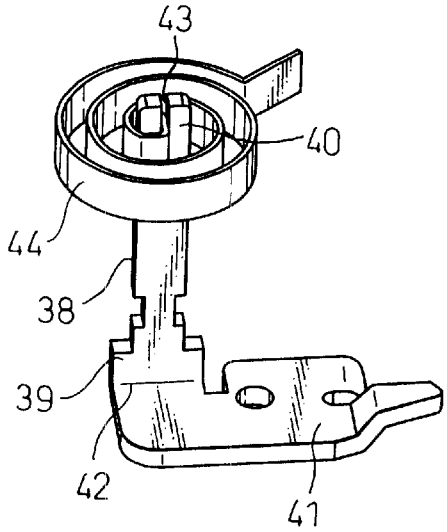

LATCH FOR OVEN

BACKGROUND OF THE INVENTION

1. Field of the Invention

The present invention relates to a latch for an oven.

2. Description of the Related Art

There is known an oven which can perform a so-called self-cleaning operation. The temperature of the oven will become very high during the self-cleaning operation and, therefore, the oven typically includes a latch for keeping the oven door closed during the self-cleaning operation (see U.S. Pat. Nos. 3,438,666 and 4,861,078).

Such a latch includes a support member mounted within the oven, and a bracket member pivotably supported on the support member. A handle is fixed to the bracket member and is operable manually to move the latch between latching and unlatching positions.

A tightened connection between the support member and the bracket member will deteriorate an easy and smooth operation of the handle. A loose connection therebetween, however, may form a clearance between the bracket member and the support member during operation of the handle. This may lead a vertical rocking of the bracket member and, accordingly, may deteriorate the stability of the operation of the latch handle.

SUMMARY OF THE INVENTION

An object of the present invention is to provide a latch for an oven which is capable of preventing the vertical rocking of the latch sufficiently, to thereby ensure the stability of the handle operation of the latch.

According to the present invention, there is provided a latch for an oven having an oven door, the latch being movable between latching and unlatching positions, comprising: a support member mounted within the oven; a bracket member pivotably supported on the support member; a handle fixed to the bracket member and manually operable to move the latch between the latching and unlatching positions; a latch arm movably supported on the support member and connected to the bracket member to be moved between the latching and unlatching positions in accordance with the movement of the bracket member, the latch arm having a catch at one end thereof for engaging with the oven door; a spring connected between the support member and the bracket member for biasing the bracket member toward the latching or unlatching position, selectively; and an arcuate guide projection integrally formed with the support member beneath the bracket member for guiding the bracket member.

The present invention may be more fully understood from the description of the preferred embodiments of the invention as set forth below, together with the accompanying drawings.

BRIEF DESCRIPTION OF THE DRAWINGS

In the drawings:

FIG. 5 is a perspective view of a bracket member and a thin metal plate;

FIG. 6 is a perspective view of a shaft member, an abutment member, and a thermal element;

DESCRIPTION OF THE PREFERRED EMBODIMENTS

Figure 1:
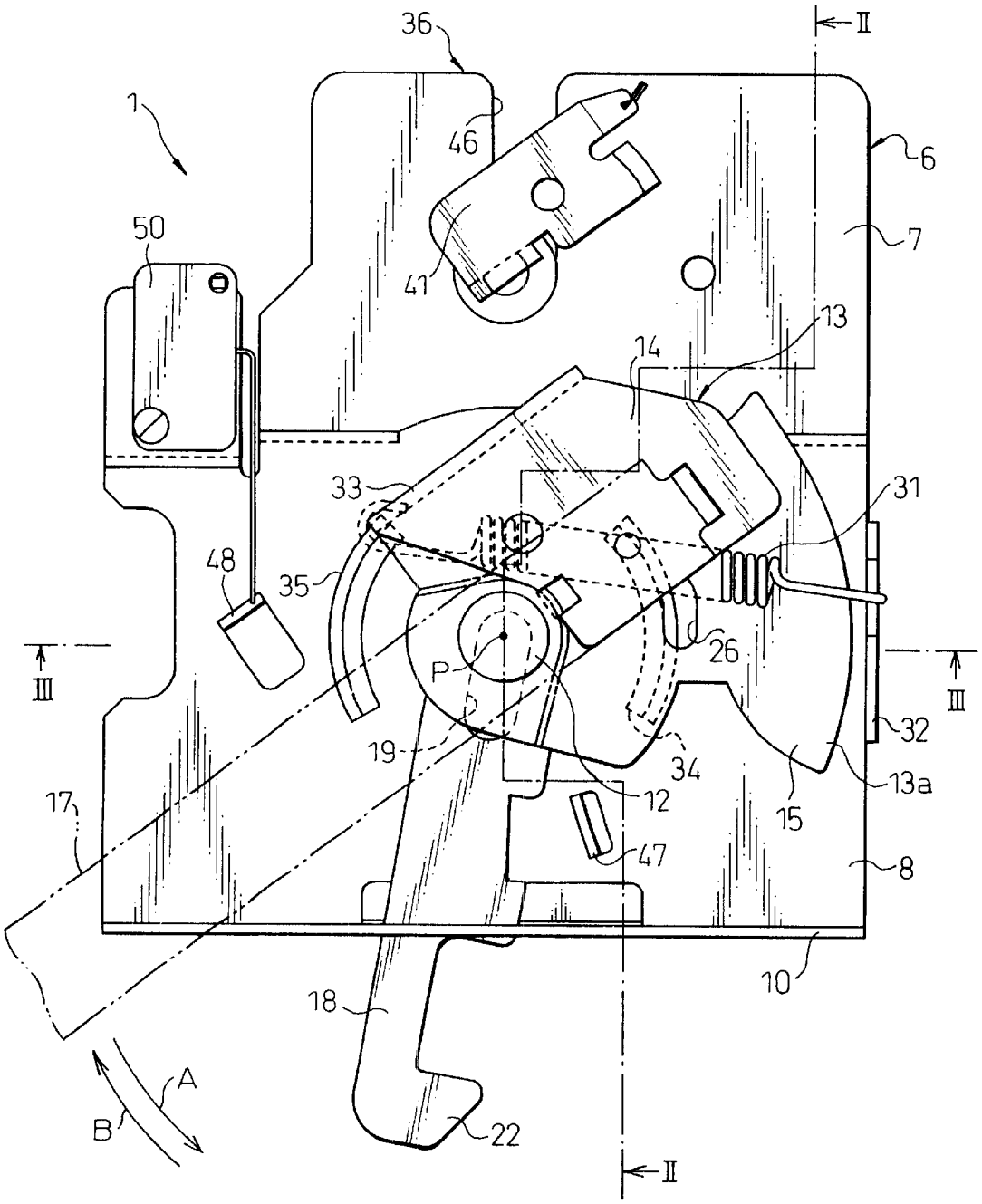
FIG. 1 is a top view of a latch.

Referring now to FIGS. 1 to 4, a latch 1 for an oven is housed in a latch chamber 2 formed in the oven above an oven cavity 3. The latch chamber 2 is defined by a vertical or front wall 4 and horizontal wall 5. The latch 1 comprises a support plate 6 including a lowered platform 7, an elevated platform 8 connected to the lowered platform 7 via a step 9, and a flange 10 with which the support plate 6 is fixed to the vertical wall 4. The platforms 7 and 8 are substantially parallel to the horizontal wall 5. The support plate 6 also includes an aperture 11 arranged on the longitudinal, center axis C—C for receiving a rivet 12.

A bracket member 13 has a generally U-shaped cross section and includes an upper wall 14, a lower wall 15, and an intermediate wall 16 between the upper and lower walls 14 and 15. The lower wall 15 is connected to the elevated platform 8 via the rivet 12 so that the bracket member 13 can pivot about the pivot axis P—P of the rivet 12. The lower wall 15 includes a horizontal projection 13*a* with which a locking assembly 36 can engage, as explained hereinafter.

To the upper wall 14, a handle 17 is fixed, a part of which is illustrated by a phantom line in FIG. 1. The distal end of the handle 17 extends outside the oven, and is manually operable to move the latch 1 between the latching and unlatching positions. The handle 17 is moved in a direction A shown in FIG. 1 when the latch 1 is to be turned to the latching position, and is moved in a direction B when the latch 1 is to be turned to the unlatching position.

Between the support plate 6 and the bracket member 13, a latch arm 18 is movably supported on the support plate 2. Specifically, the latch arm 18 includes an elongated aperture 19 through which the rivet 12 extends. Thus, the latch arm 18 can move along the elongated aperture 19 with respect to the rivet 12 and can pivot about the rivet 12.

Figure 4:
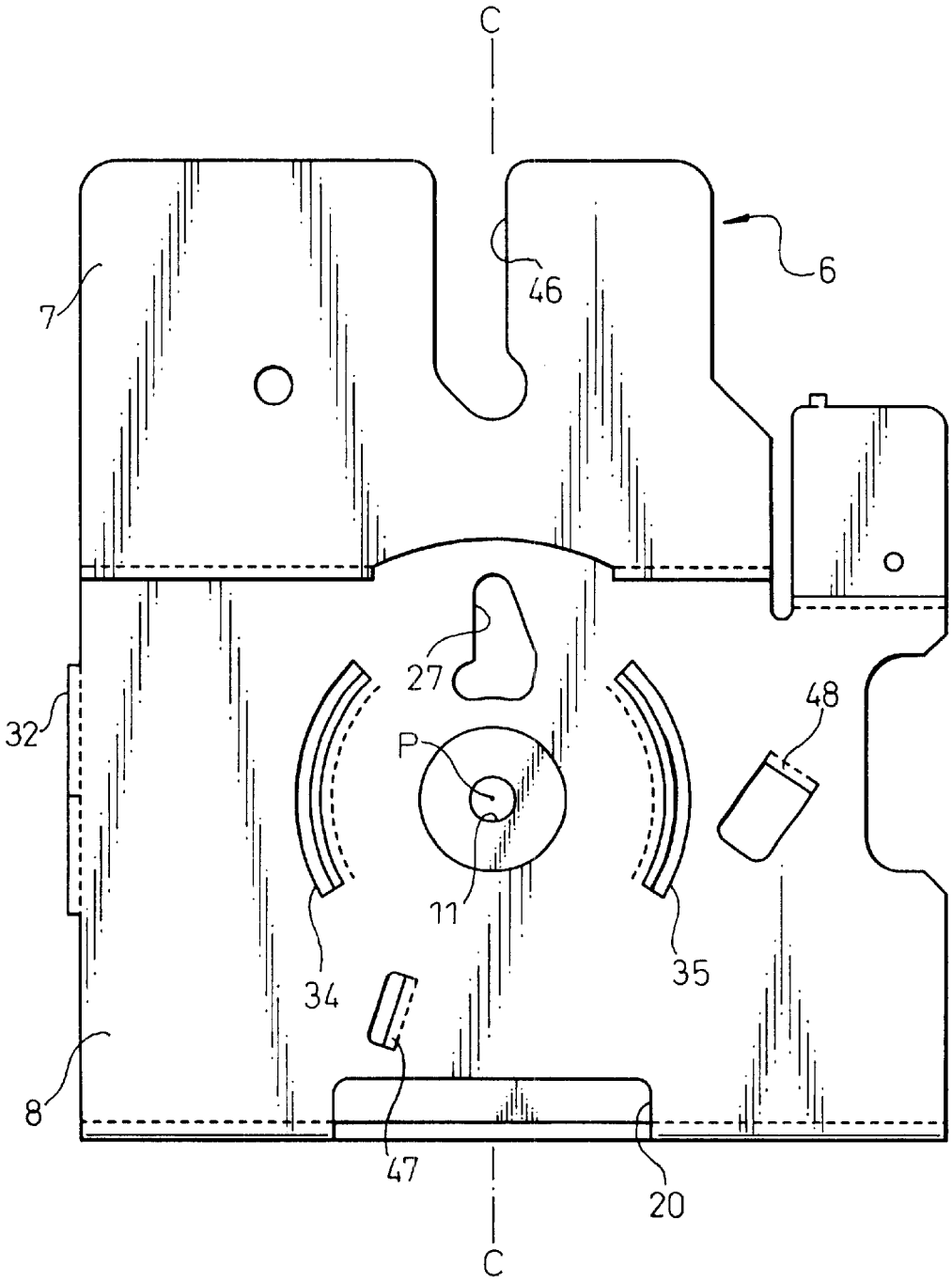
FIG. 4 is a bottom view of a support plate.
Figure 8:
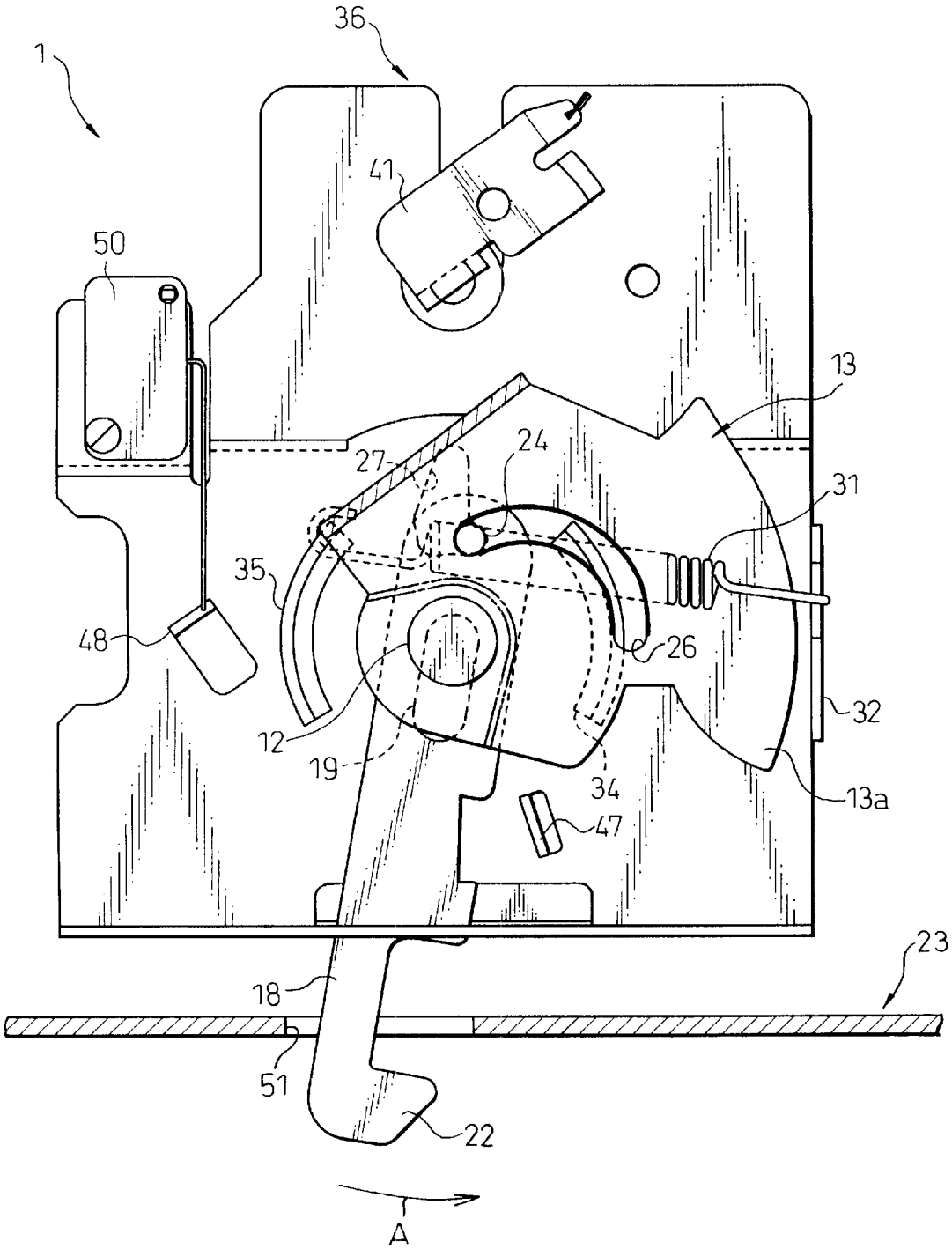
FIG. 8 is a schematic top view of the latch, in which a upper wall of a bracket member and a handle are omitted for clarification, showing the latch in the unlatching position and the abutment member in a first position.

The latch arm 18 extends outside the oven through slots 20 and 21 formed in the flange 10 and in the vertical wall 4, respectively. The distal end of the latch arm 18 includes a catch 22 for engaging with a door 23 of the oven (FIG. 8). The latch arm 18 also includes vertical projections 24 and 25 at the proximal end thereof and opposite to the catch 22 with respect to the elongated aperture 19. One of the projections 24 extends from the latch arm 18 upwardly and is received within an arcuate slot 26 formed in the lower wall 15 of the bracket member 13. The other projection 25 extends from the latch arm 18 downwardly and is received within a slot 27 formed in the elevated platform 8 of the support plate 6. When the bracket member 13 is pivoted about the rivet 12, the slots 26 and 27 guide and move the corresponding projections 24 and 25, and thereby move the latch arm 18. Note that the center of the arc of the slot 26 is offset from the pivot axis P—P, and that the slot 27 is arranged on the center line C—C of the support plate 6 as shown in FIG. 4.

The rivet 12 is loosely caulked to connect the bracket member 13 and the latch arm 18 to the support plate 6 movably. Such a loose rivet connection provides a smooth movements of the bracket member 13 and the latch arm, but allows the vertical rocking of the bracket member 13.

A thin metal plate 28 is inserted between the bracket member 13 and the latch arm 18. As shown in FIG. 5, the metal plate 28 has projections 29, 29 inserted into the slot 26 of the bracket member 13 and, therefore, it is held by the bracket member 13. The metal plate 28 also includes an arcuate slot 30 which is substantially same as the slot 26 in shape, to receive the projection 25 of the latch arm 18.

In order to ensure high wear resistance, case hardening is required for the conventional bracket member. The metal plate 28 in accordance with the present invention omits such a costly and complicated process.

Referring to FIGS. 1 to 4 again, a spring 31 is provided for biasing the bracket member 13 toward the latching or unlatching position, selectively. One end of the spring 31 is connected to an anchor 32 formed in the support plate 6 and the other end is connected to an anchor 33 formed in the intermediate wall 16.

The support plate 6 also includes first and second arcuate guide projections 34, 35 beneath the bracket member 13. The support plate 6 is staked upwardly to provide the guide projections 34, 35 integrally therewith. Each of the guide projections 34, 35 has a substantially L-shaped cross section with a horizontal top surface, on which the lower wall 15 of the bracket member 13 slides, as shown in FIG. 3.

The first and second guide projections 34, 35 are arranged along a path of the bracket member 13, and symmetrically with respect to the central axis C—C of the support member 6. The first guide projection 34 is arranged on the same side as the anchor 32 with respect to the pivot axis P—P, and the second guide projection 35 is arranged on the opposite side of the anchor 32 with respect to the pivot axis P—P.

Figure 3:
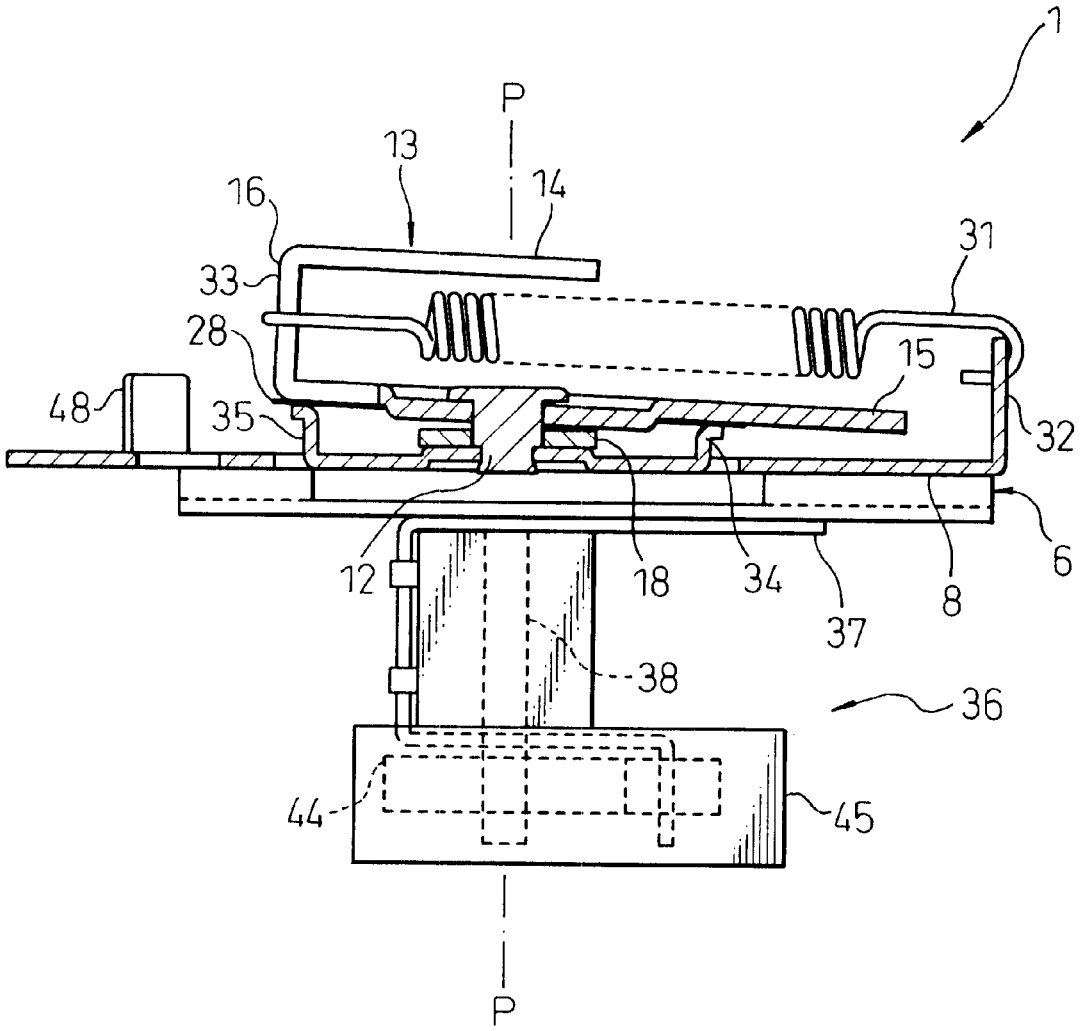
FIG. 3 is a schematic cross sectional view of the latch, taken along line III—III in FIG. 1.

As shown in FIG. 3, the bracket member 13 is inclined toward the anchor 32 due to the spring 31. Therefore, the second guide projection 35 has a height larger than that of the first guide projection 34, in order to omit the substantial clearance between the bracket member 13 and the guide projections 34, 35. Note that the guide projections 34, 35 also serve as ribs which reinforce the support plate 6.

The latch 1 also includes a locking assembly 36 for locking movement of the bracket member 13. The locking assembly 36 includes a holder 37 which is fixed the bottom surface of the support plate 6 and is formed from a plate with several bends. A shaft member 38 is pivotably supported on the holder 37, and has opposing first and second ends 39 and 40. An abutment member 41 is connected to the first end 39 of the shaft member 38, to which the projection 13*a* of the bracket member 13 can abut, as explained hereinafter. The abutment member 41 is pivotable together with the shaft member 38.

As shown in FIG. 6, the shaft member 38 and the abutment member 41 are formed of a small metal strip in one piece with a bend 42. The shaft member 38 has at its end a slit 43 in which one end of a thermal element 44 is received. The other end of the thermal element 44 is fixed to the holder 37. The thermal element 44 is comprised of a coiled bimetallic strip, and provides pivotal movement of the abutment member 41, in responsive to the oven temperature. Specifically, when the oven temperature is low, the abutment member 41 is maintained in a first position where the abutment member 41 is removed from the path of movement of the bracket member 13. When the oven temperature becomes high, the abutment member 41 is moved toward a second position where the abutment member 13 is disposed within the path of movement of the bracket member 13, and is maintained in the second position.

Figure 2:
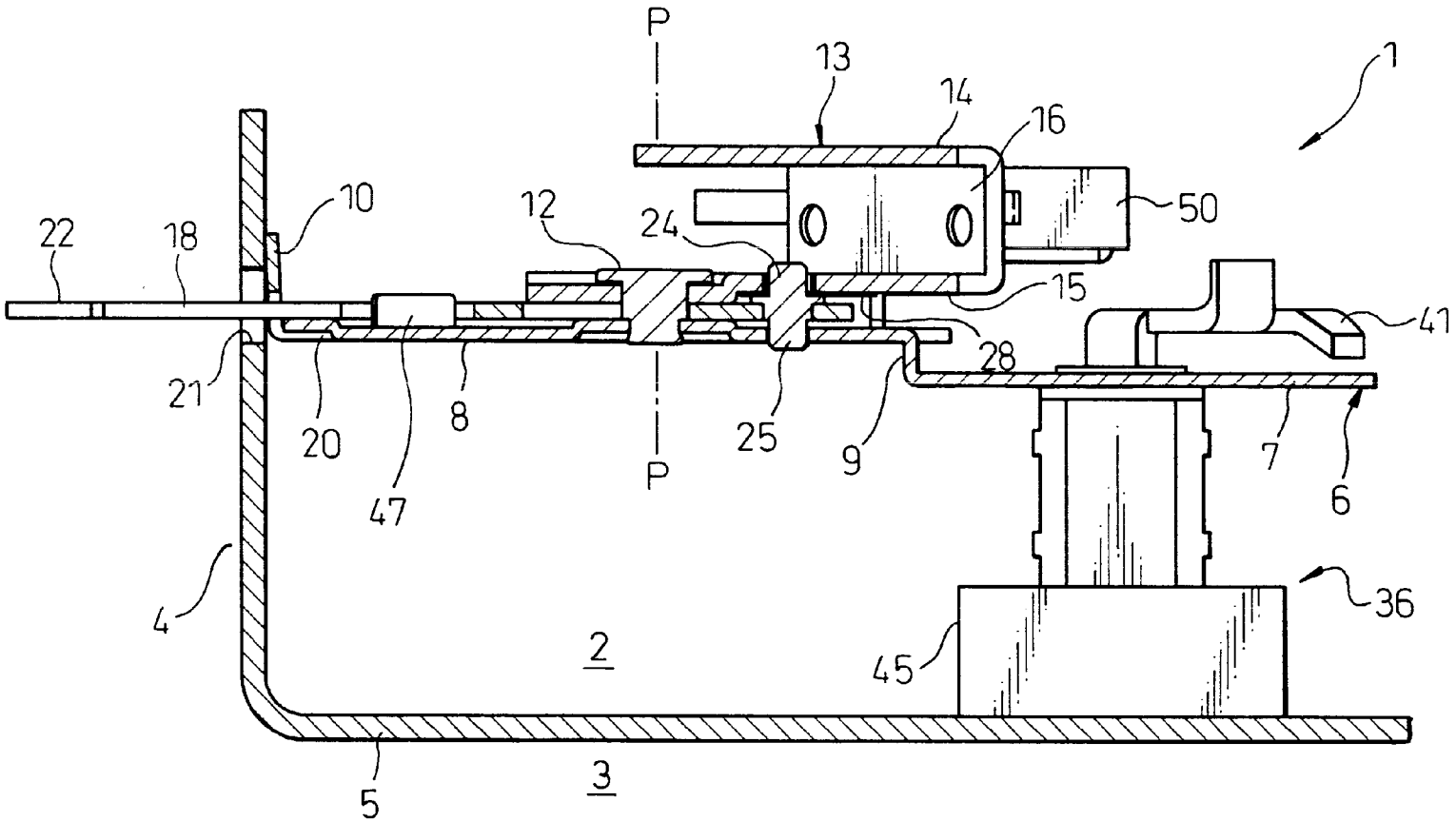
FIG. 2 is a schematic cross sectional view of the latch, taken along line II—II in FIG. 1, in which a spring is omitted for clarification.

The shaft member 38 and the bimetallic coil 44 are surrounded by a cover 45. The cover 45 has an open end which is pressed against to the horizontal wall 5, as shown in FIG. 2. Therefore, the bimetallic coil 44 is sensitive to the oven temperature.

Figure 7:
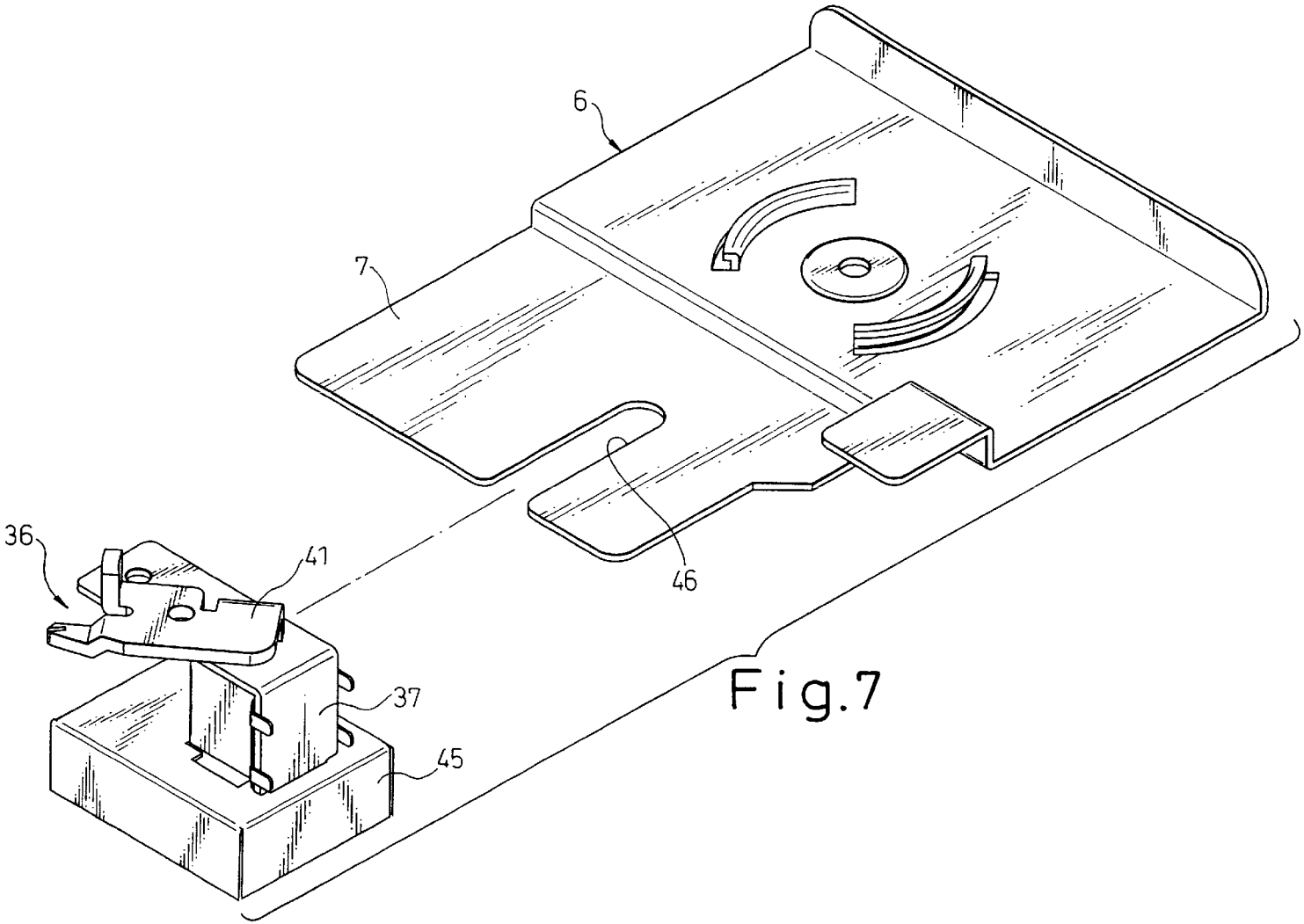
FIG. 7 is a schematic perspective view of a support plate and a locking assembly in a disassembled condition.

As shown in FIG. 7, the lowered platform 7 of the support plate 6 includes a slot 46 with an open end. The shaft member 38 is movably received within the slot 46 when the locking assembly 36 is fixed to the lowered platform 7. Accordingly, the lock assembly 36 can be removed from the support plate 6 without any disassembly of the lock assembly 36.

The elevated platform 8 of the support plate 6 is upwardly staked to provide pawls 47 and 48. The pawl 47 engages with the latch arm 18 when the oven door 23 is not closed, in order to avoid the activation of the self-cleaning operation. The pawl 48 is positioned in the path of the bracket member 13 to limit the movement of the bracket member 13 up to the latching position.

An electric switch 50 for activating the self-cleaning operation of the oven is also supported on the support plate 6. Contact of the bracket member 13 to the switch 50 will activate the self-cleaning operation of the oven.

Figure 9:
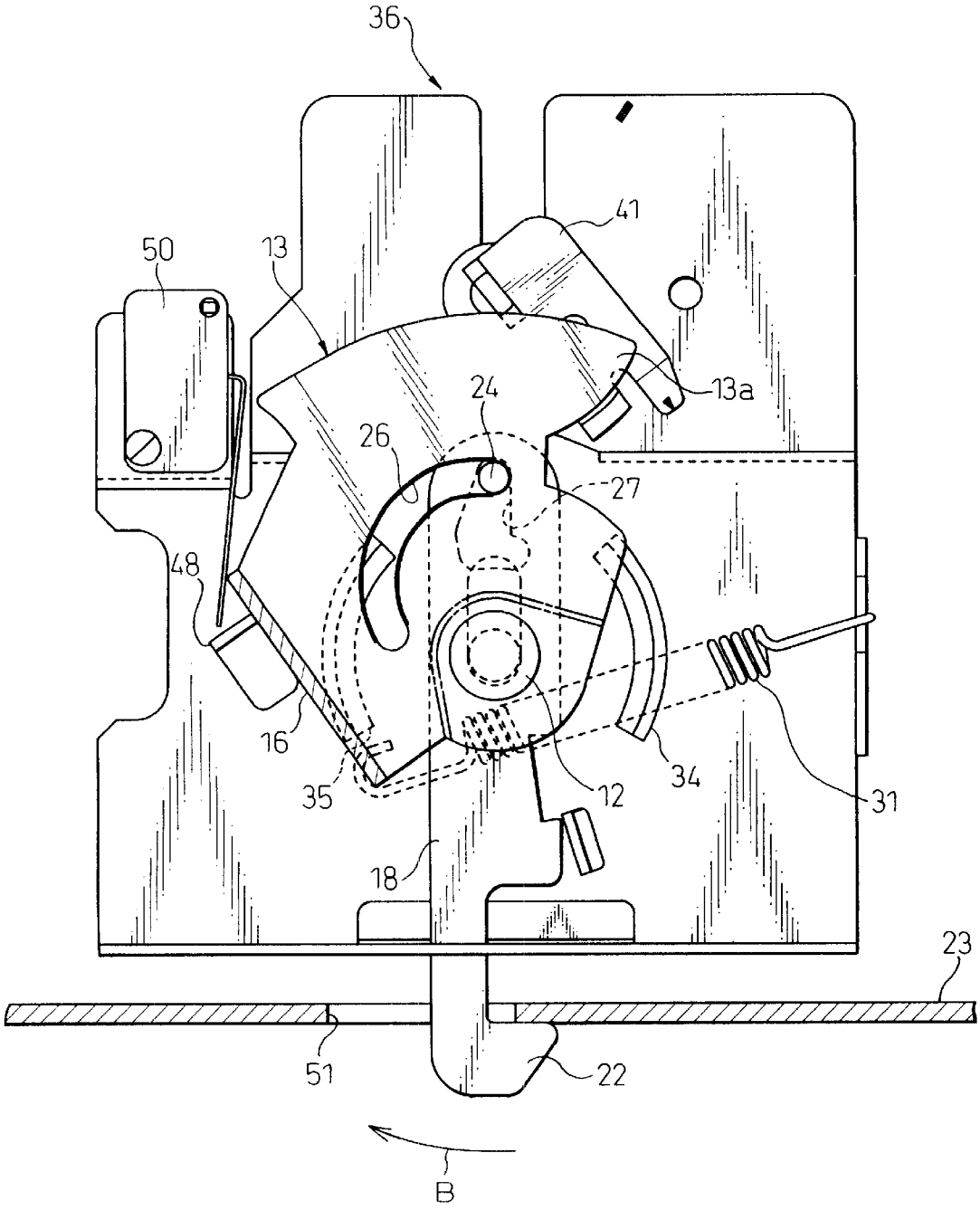
FIG. 9 is a schematic top view of the latch as shown in FIG. 5, showing the latch in the latching position and the abutment member in a second position.

Next, an operation of the latch 1 will be explained with reference to FIGS. 8 and 9. FIG. 8 shows the latch 1 in the unlatching position, and FIG. 9 shows the latch 1 in the latching position In the unlatching position, the bracket member 13 and the latch arm 18 are maintained in the unlatching position by the spring 31 and by the engagements between the projections 24 and 25 and the slots 26 and 27. When the oven door 23 is closed, the catch 22 of the latch arm 18 extends into an opening 51 formed in the oven door 23.

When the handle 17 is moved in the direction A and thereby the bracket member 13 is pivoted about the rivet 12 in the direction A, first, the latch arm 18 is pivoted about the rivet 12 in the direction A. When the catch 22 abuts the wall defining the opening 51, further movement of the bracket member 13 in the direction A moves the latch arm 18 axially along the elongated aperture 19, as shown in FIG. 8.

When the bracket member 13 abuts the pawl 48, the latch 1 is in the latching position. In the latching position, the catch 22 firmly engages the opening 51 and keeps the oven door 23 closed, as shown in FIG. 9. Further, the bracket member 13 and the latch arm 18 are maintained in the latching position by the spring 31 and by the engagements between the projections 24 and 25 and the slots 26 and 27.

When the bracket member 13 enters in the latching position and thereby turns on the switch 50, the self-cleaning operation is automatically started. When the temperature in the oven cavity 3 is low, the abutment member 41 is in the first position where the abutment member 13 is out of the path of movement of the bracket member 13 to allow the movement of the bracket member 13 from the latching position to the unlatching position.

When the oven temperature becomes high, the bimetallic coil 44 pivots the abutment member 41 from the first position to the second position where the abutment member 41 is disposed within the path of movement of the bracket member 13 to block the movement of the bracket member 13 from the latching position to the unlatching position, as shown in FIG. 9. Therefore, the latch 1 cannot be moved to the unlatching position. This ensures that the oven door 23 is kept closed during the self-cleaning operation.

When the self-cleaning operation is completed, the oven temperature gradually drops toward room temperature. When the oven temperature becomes low, the bimetallic coil 44 returns back the abutment member 41 from the second position to the first position. Then, the latch 1 can be returned to the unlatching position and thereby the oven door 23 can be opened.

When the bracket member 13 is pivoted, the bracket member 13 always slides on the guide projections 34, 35. This avoids the vertical rocking of the bracket member 13 and, therefore, ensures the stability and smoothness of the handle operation even with the loose rivet connection.

According to the present invention, it is possible to provide a latch for an oven which is capable of preventing the vertical rocking of the latch sufficiently, to thereby ensure the stability of the handle operation of the latch.

While the invention has been described by reference to specific embodiments chosen for purposes of illustration, it should be apparent that numerous modifications could be made thereto by those skilled in the art without departing from the basic concept and scope of the invention.

What is claimed is:

1. A latch for an oven having an oven door, the latch being movable between latching and unlatching positions, comprising:

a support member mounted within the oven;

a bracket member pivotably supported on the support member;

a handle fixed to the bracket member and manually operable to move the latch between the latching and unlatching positions;

a latch arm movably supported on the support member and connected to the bracket member to be moved between the latching and unlatching positions in accordance with the movement of the bracket member, the latch arm having a catch at one end thereof for engaging with the oven door;

a spring connected between the support member and the bracket member for biasing the bracket member toward the latching or unlatching position, selectively; and an arcuate guide projection integrally formed with the support member beneath the bracket member for guiding the bracket member.

2. A latch according to claim 1, wherein first and second guide projections are provided along a path of the bracket member.

3. A latch according to claim 2, wherein the bracket member has a pivot axis about which the bracket member pivots, wherein the support member has an anchor to which the spring is connected, and wherein the first guide projection is arranged on the same side as the anchor with respect to the pivot axis, and the second guide projection is arranged on the opposite side to the anchor with respect to the pivot axis.

4. A latch according to claim 3, wherein the second guide projection has a height larger than that of the first guide projection.

5. A latch according to claim 2, wherein the first and second guide projections are arranged symmetrically with respect to the longitudinal axis of the support member.

6. A latch according to claim 1, wherein the support member is staked upwardly to provide the guide projection.

7. A latch according to claim 1, wherein the guide projection has a L-shaped cross section with a top surface on which the bracket member slides.

8. A latch according to claim 1, further comprising a locking assembly including:

a holder fixedly supported on the support member;

a shaft member pivotably supported on the holder and having opposing first and second ends;

an abutment member connected to the first end of the shaft member, to which the bracket member can abut, the abutment member being pivotable together with the shaft member; and a thermal element connected between the holder and the second end of the shaft member for pivoting the abutment member, in responsive to the temperature of the oven, between a first position where the abutment member is removed from the path of movement of the bracket member to allow the movement of the bracket member from the latching position to the unlatching position, and a second position where the abutment member is disposed within the path of movement of the bracket member to block the movement of the bracket member from the latching position to the unlatching position.

9. A latch according to claim 8, wherein the support member includes a slot with an open end for receiving the shaft member therein, whereby the lock assembly can be removed from the support member without any disassembly of the lock assembly.

10. A latch according to claim 8, wherein the abutment member and the shaft member are formed in one piece with a bend.

11. A latch according to claim 1, wherein the latch arm is positioned between the bracket member and the support member, and wherein a thin metal plate is inserted between the bracket member and the latch arm, the metal plate having a projection which is inserted into an aperture formed in the bracket member to be held by the bracket member.

* * * * *